United States Patent [19]

Alf et al.

[11] Patent Number: 4,857,014

[45] Date of Patent: Aug. 15, 1989

[54] AUTOMOTIVE ANTENNA COAXIAL CONVERSION PLUG-RECEPTACLE COMBINATION ELEMENT

[75] Inventors: Reinhard Alf; Wolfgang Warzecha, both of Berlin, Fed. Rep. of Germany

[73] Assignee: Robert Bosch GmbH, Stuttgart, Fed. Rep. of Germany

[21] Appl. No.: 230,140

[22] Filed: Aug. 9, 1988

[30] Foreign Application Priority Data

Aug. 14, 1987 [DE] Fed. Rep. of Germany ..... 3727116

[51] Int. Cl.[4] ..... H01R 17/06

[52] U.S. Cl. ..... 439/578; 439/628

[58] Field of Search ..... 439/578–585, 439/628

[56] References Cited

U.S. PATENT DOCUMENTS

| | | | |
|---|---|---|---|
| 1,871,397 | 8/1932 | Watts | 439/582 |
| 3,022,482 | 2/1962 | Waterfield et al. | 439/584 |
| 4,099,825 | 7/1978 | Jackson | 439/578 |

FOREIGN PATENT DOCUMENTS 1258946 1/1968 Fed. Rep. of Germany .

OTHER PUBLICATIONS

Industrial Specification DIN 41 585.

*Primary Examiner*—Joseph H. McGlynn
*Attorney, Agent, or Firm*—Frishauf, Holtz, Goodman & Woodward

[57] ABSTRACT

To connect an old-model antenna receptacle (40) to a new-model car radio antenna connector (50), a unitary conversion plug is provided which has an outer tubular conductor (19) secured over an insulating sleeve (20), formed with a central opening within which an inner conductor (12, 18) is located. The inner conductor has a pin portion (18) projecting from and fitting into the old-model receptacle, and a bushing-like receptacle portion (15), electrically coupled directly or via a capacitor (FIGS. 7–11) to the pin portion, the bushing-like receptacle portion being adapted to receive a central connecting pin of the new-model antenna plug (50). The outer conductor (19) has a first connecting portion (13) dimensioned to fit into an outer bushing terminal (40*a*) of the old-model receptacle and a second connecting portion (16) dimensioned to fit into a cup-shaped connecting element (51) of the new-model antenna plug, the elements being respectively retained on the tubular insulating sleeve by barbs, rolled-over surfaces, and stepped regions, and axially dimensioned to fit into the old-model receptacle and project just enough therefrom to permit placement of the new-model plug thereover.

14 Claims, 3 Drawing Sheets

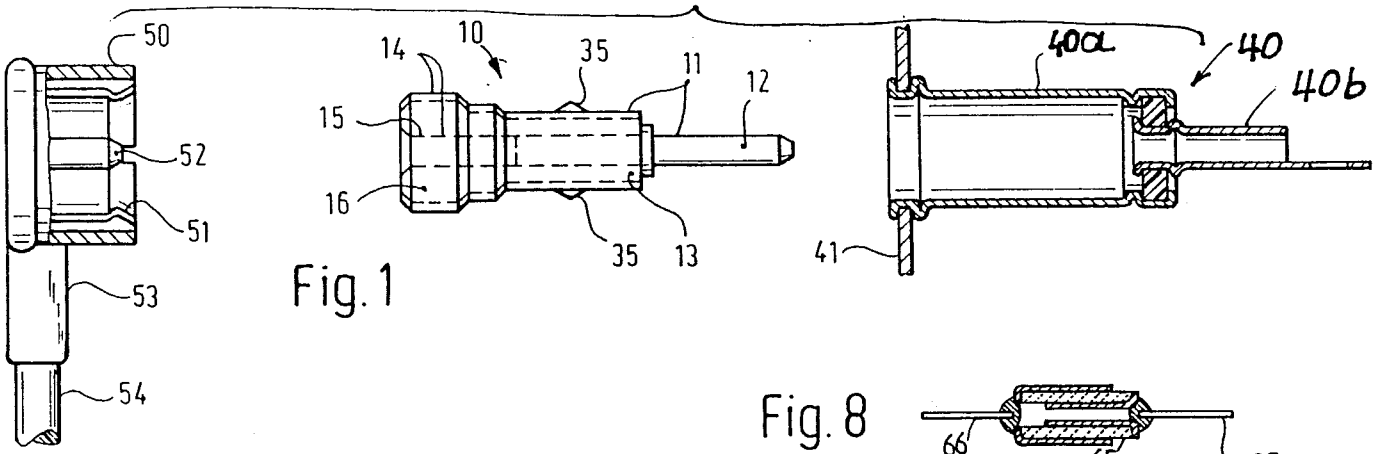
Fig. 1
Fig. 8
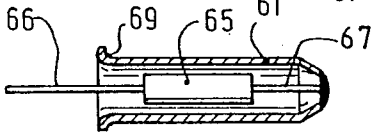
Fig. 9
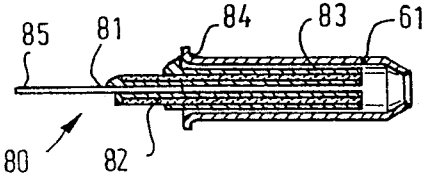
Fig. 10
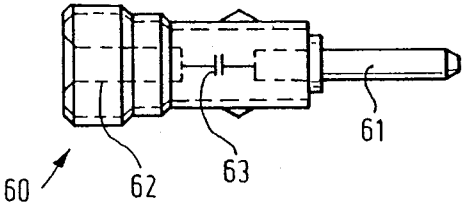
Fig. 7

AUTOMOTIVE ANTENNA COAXIAL CONVERSION PLUG-RECEPTACLE COMBINATION ELEMENT

The present invention relates to a connector element for high-frequency currents, and more particularly to a coaxial conversion plug-receptacle combination element to connecan automotive antenna to an automovite or vehicular-type radio equipment, for example a car radio. In the specification and claims that follow, "car radio" will be used for short although it is understood that other types of high-frequency communication equipment in which signals are transferred from an antenna to the equipment itself are to be included therein, such as citizen-band radios, mobile telephones, and other types of radio radiation-responsive communication equipment.

BACKGROUND

Vehicular or car radio antenna cables are typically connected to a car radio by a plug unit which has a tubular inner conductor, an insulator receiving the inner conductor at least over a portion of its length, and an exposed outer conductor. The exposed outer conductor may be formed with springs or other resilient elements which pass through the insulator. The plug is adpated to be connected to a receptacle which has a tubular receiving element for the tubular inner conductor and a bushing-like outer element with an inner conductive surface or conductive strip to engage with the contact springs of the plug element. The plugs as well as the bushings are standardized, as described, for example, in Industrial Standard DIN 41 585. The standards are so arranged that plugs will fit into the respective sockets or receptacles.

The plugs, with their projecting pins, are comparatively lengthy. The space available to fit a car radio in a radio compartment of an automotive dashboard becomes less and less, particularly as the size of vehicles decreases. It is, therefore, desirable to also decrease the space requirements, and specifically the longitudinal extent of the antenna connection, which is required either within the car radio structure or which projects from the car radio. In order to decrease the connecting depth, a new type of angle connector has been proposed. This new angle connector has, as a characteristics, a cup-like outer conductor, in which the conductive surface is at the inside. The cup-like outer conductor is surrounded by an insulator. The cup-like outer conductor surrounds a bushing-like outer conductor of the matching socket or receptacle and, typically, forms a spring connection therewith.

New car radios will be fitted with the receptacles for new car antennas, including the new antenna plug. It is unavoidable, however, that car radios will be in use and on the market which have the old-type antenns connection, subject to the Industrial Standard DIN 41 585, and which are to be connected to a new-type antenna, for example the antenna required replacement, and antenna with old-type connectors are no longer available.

THE INVENTION

It is an object to provide a conversion plug element which permits fitting the new type antenna connector on the old-type antenna connection bushing of the old car radio without substantially extending the axial dimension of the car radio and antenna connector, so that the space available for the car radio, with the new antenna connector within a given vehicle, can be accomodated and does not requre extension.

Briefly, the conversion plug includes an inner conductor having a pin portion and a bushing-like receptacle portion electrically coupled to the pin portion. The pin portion is intendd to be received in the existing car radio socket and the bushing-like receptacle portion is intended to receive the central pin of the new antenna cup connector. An insulating sleeve is formed with a central through-opening and receives and retains the inner conductor. Likewise, it retains an outer conductor thereon. The outer conductor has a first connection portion dimensioned to fit into the outer sleeve terminal of the old-model receptacle of the radio, and a second connectng portion which has an outer diameter dimensioned to fit within the cup-shaped connection element of the new-type or new-model antenna cup connector. The two portions form a unitary element, secured to the insulating sleeve. A capacitor can be included in the inner conductor, for example by galvanically separating the pin portion and the bushing-like receptacle portion and placing a capacitor therebetween.

The connector has the advantage that an old-model radio receptacle element can be readily coupled to a new-model antenna with its cup connector, with an inexpensive simple element which does not substantially extend the dimension of the radio; further, the arrangement is so made that the outer conductor effectively shields the inner conductor against stray or noise or disturbance fields, while providing a reliable high-frequency coupling connection between an old-style or old-model or old-standard radio connector and a new-model or new-standard cup antenna connector.

DRAWINGS, ILLUSTRATING EMBODIMENTS OF THE INVENTION

FIG. 1 is an enlarged exploded view of the conversion plug element and illustrating, partly in section, the new-model cup antenna element and the old-model antenna bushing of a car radio;

FIG. 7 is a side view, partly in phantom representation, of the conversion element with a capacitor integrated therein;

FIG. 8 is a fragmentary sectional view of a suitable capacitor for use in the embodiment of FIG. 7;

FIG. 9 is a sectional view of the inner conductor with a capacitor inserted therein;

FIG. 10 is a sectional view of a pin-like inner conductor with a capacitor secured thereto;

DETAILED DESCRIPTION

Figure 3:
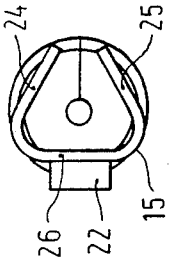
FIG. 3 is an end view of the inner conductor of FIG. 2, to a still larger scale.

The conversion plug 10 is intended to connect a new-model cup style antenna connector 50 to an old-model bushing 40, made and dimensioned in accordance with Industrial Standard 41 585 of a car radio. The conversion plug 10 has a first end portion 11, dimensioned in accordance with Standard DIN 41 585, including a projecting pin-like inner conductor 12 and a sleeve-like outer conductor 13. The outer conductor 13 is intended to make electrical connection with bushing 40*a* of the receptacle 40; the pin element 12 is intended to fit into the sleeve 40*b* of the receptacle 40. The portion 40*b*, for example within the end wall 41 of the car radio, is not inherently shielded by the outer bushing 40*a*.

The conversion plug 10, at its left end (FIG. 1), has an outer conductor 16 which fits within the outer conductor 51 of the cup-angle connector in accordance with the model. The inner conductor is formed as a bushing 15 to receive pin element 52 of the new model cup-conductor, the two conductors 15, 16 together forming the conductive portions of the adpator end part 14.

Figure 2:
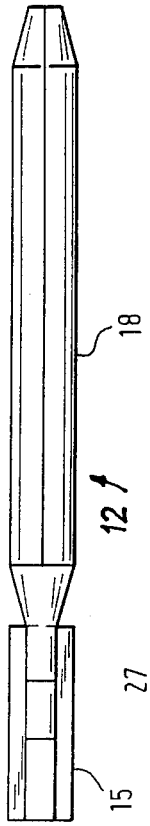
FIG. 2 is a side view of the inner conductor of the conversion plug, to an enlarged scale with respect to FIG. 1.
Figure 5:
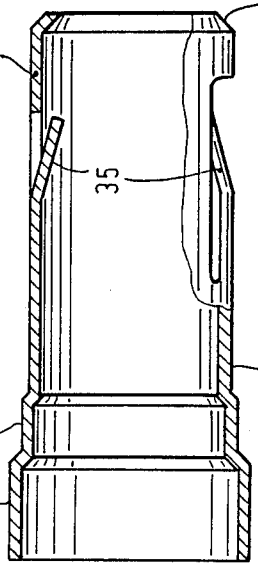
FIG. 5 is an axial section of the outer conductor of the conversion element.
Figure 6:
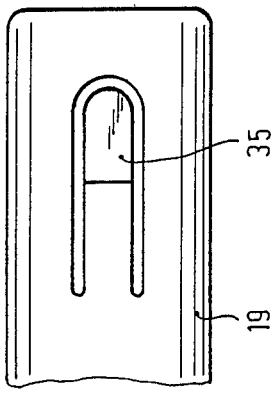
FIG. 6 is a fragmentary side view of a portion of the outer conductor, to an enlarged scale.

The inner conductor portions 12 and 15 can be constructed as a single unitary element 18, see FIG. 2; the two outer conductor portions 13 and 16 form a single unitary element 19, see FIG. 5.

Figure 4:
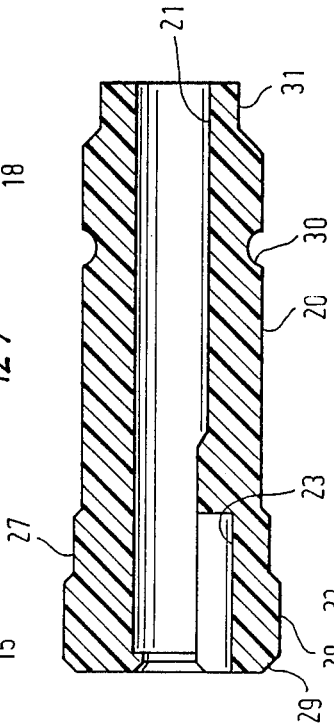
FIG. 4 is an axial section through an insulating body of the conversion element.

The inner conductor 18 and the outer conductor 19 are electrically separated by a tubular insulating sleeve or bushing 20, see FIG. 4. Bushing 20 has an axial through-bore or opening 21 with an enlargement 23 at the left end, with respect to FIG. 4. The inner conductor element 12 is formed at the left end with a radial flap 22. It is bent in general U-shape, with two converging legs 24, 25 attached to the radial flap 22. The legs 24, 25, together with the bottom portion 26, form a general harp-like structure.

The insulating body 20, see FIG. 4, is formed with an external stepped surface. In the region of the enlargement 23, its has first and second outer steps 27, 28. The diameter of the portion 27 is greater than the diameter of the portion 20 which is free from steps; the dimension of the second stepped region 28 is larger than the diameter of the first stepped portion 27. The end region of the stepped portion 28 is chamfered or rounded, as shown at 29.

The section 28 is formed with a circumferential groove or with notches 30. The right terminal end is reduced in diameter, as seen at 31, to form a third step. The diameter of the region 31 is less than the diameter of the general longitudinal portion of the insulating body 20.

The outer conductor 19 can be a drawn sheet-metal element which has stepped regions 32, 33, matching the steps 27, 28 of the insulating body 20. The outer condutor 19 is conically tapared inwardly, as seen at 34. The central region of the outer conductor 19 has two axial flaps 35 punched therein which are generally inwardly directed.

ASSEMLBY

The inner conductor 18 is first pushed from the left, FIG. 4, through the axial opening of the insulating body 20, with the pin-like connector portion 12 forward , until the flap 22 (FIG. 3) engages the end wall of the inner enlargement 23. Barbs, not shown and well known in the field of connectors, can be punched out for example from the legs 24, 25 or the base connection portion 26, or from the longitudinal flap 22, so that the inner conductor cannot be removed from the insulating body 20, once inserted therein.

The outer conductor 19 is then fitted on the insulating body 20 from the right side of the insulating body. The ends of the flaps 35 will engage in the groove 30 and snap resiliently into the groove 30. A short movement of the outer conductor, then, towards the right, with respect to FIG. 4, will deform the flaps 35 so that they are pressed slightly outwardly to form outwardly bulging in springy contact elements, see FIG. 1. When the insulating body 20 and the outer conductor 19 are appropriately secured, the terminal portion of the end region 33 rolled or peened over the chamfered surface 29 of the insulating body 20 so that it is securely seated on the insulating body.

The portion 11 of the connector plug 10 fits within the receptacle 40 in accordance with Standard DIN 41 585. The receptacle 40 can be secured, for example, to a back wall 41 of a car radio. The pin 12 fits into the sleeve portion 40*b*, the outer conductor 19 fits within the bushing portion 40*a*, and the projecting spring elements 35 make reliable electrical connection to the bushing 40*a*.

The portion 14 of the conversion plug 10 fits into the new model cup connector 50 which is different from the Standard 41 585, and includes a cup-like outer conductor 51, entirely surrounding and shielding, with respect to disturbance fields, a pin-like inner conductor 52. The connector 50 is part of an angle connector 53 coupled to an antenna cable 54 which, in turn, is connected to a car radio antenna.

Various types of antennas desirably use a capacitor. Such a capacitor is frequently needed since the connecting capacitance of new-style or new-model car radio antennas must be matched to the input capacitance of standard car radios. Placing a capacitor 63 (FIG. 7) in series electrical connection to the inner conductor of the antenna cable decreases the overall input capacitance connected to the car radio. FIGS. 7 to 10 illustrate such connectors 60 which differ from the connector of FIG. 1 in that the pin-like inner conductor 61 and the bushing-like inner conductor portion 62 are electrically connected by capcitor 63.

Figure 11:
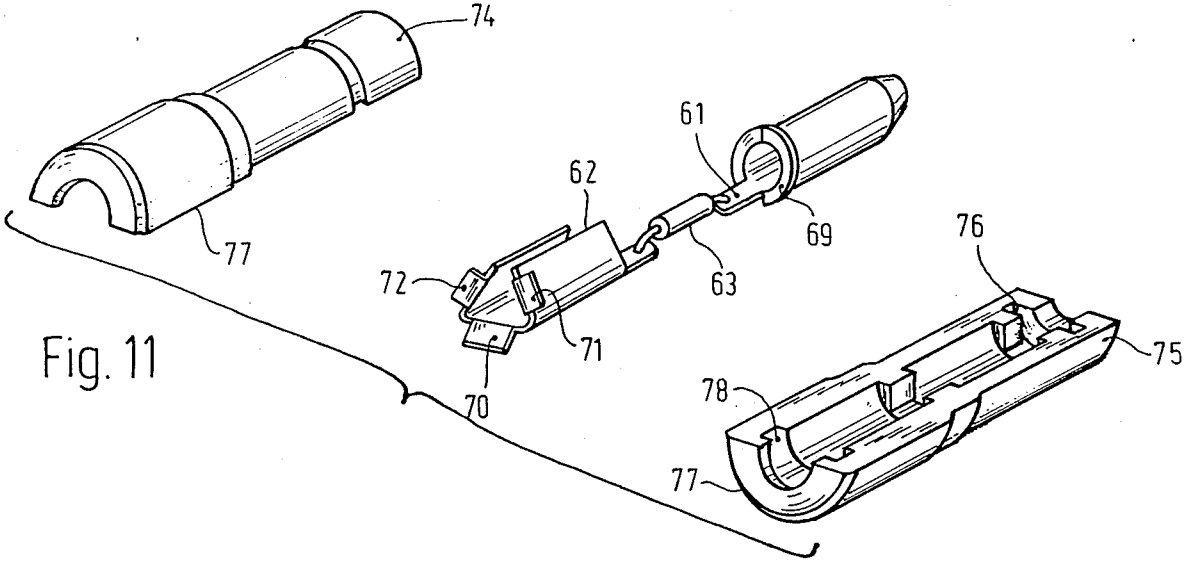
FIG. 11 is an exploded perspective view of a two-part or slit insulator, with an inner conductor formed of two elements coupled by a capacitor.

Capcitor 63, see FIG. 8, may be for example a cylindrical capacitor structure 65 with axial terminals 66, 67 which are fitted, as best seen in FIG. 9, within the hollow interior structure of the inner conductor 12. Terminal 67 is connected with the free end of the inner conductor 12 and terminal 66 with the inner conductor part 62 (FIG. 11). The capacitor 65 of FIG. 8 is surrounded with an insulation material, as well known, and omitted from the drawings for clarity. The inner conductor 12, thus, is separated into two parts 61, 62, as best seen in FIG. 11.

The inner conductor part 61 has a radially extending collar or flange which is fitted into corresponding grooves 76 of the insulating body 77. The insulating body 77 is formed of two axially split half sections 74, 75. The inner conductor part 62, similar to the flap portions 24, 25 and 26 of the part 15, is formed with radially extending or external flaps 70, 71, 72 which, in turn, fit into corresponding grooves 78 of the half elements 74, 75 of the insulating body.

ASSEMBLY

The inner conductor structure formed of the two parts 61, 62 is assembled in one half part of the insulator, with the flaps 70, 71, 72 fitting in grooves 78, and the flange or similar flaps 69 fitting into groove 76. The two half parts of the insulator are then fitted against each other and the now assembled inner conductor with the insulating body can be introduced into the outer conductor 19, as shown in FIG. 5.

The capacitor can be formed in various and differently connected than shown in FIG. 8.

FIG. 9 illustrates a capacitor 65 in which the lead 67 is soldered to an end portion of the sleeve element 61, and located within the inner conductor. FIG. 10 illustrates a capacitor in the form of a tubular capacitor 80 which is fitted on a wire element 81, and secured to an inner layer 82 of the capacitor by soldering. An outer layer 82 of the tubular capacitor is secured, for example, to the flange 84 of the inner conductor 61, also be soldering. The wire element 81 is galvanically separated from the inner conductor 61. The end portion 85 of the wire element 81 can then be connected directly to the part 62 (FIG. 11) of the inner conductor, for example by soldering.

Figure 12:
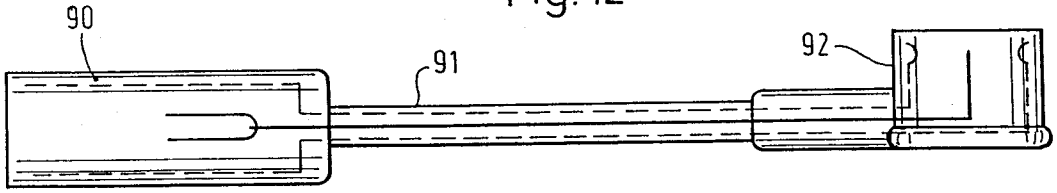
FIG. 12 is a schematic side view of a connecting cable.

The conversion plug 10, with or without the capacitor, and illustrated in FIGS. 1–11, is suitable for connecting the new-model antenna connector 50, 53 with an old-model antenna receptacle 40. The reverse, namely to connect an old-model antenna, for example in an existing vehicle, with a new-type car radio having a receptacle adapted to fit the terminal element 50, 53, is preferably done by means of a connecting cable, as shown in FIG. 12. The coupling element 90, well known and made in accordance with the Standard DIN 41 585, is coupled via a cable 91 to an angle connector 92 which can be similar to the angle connector 50, 53 of FIG. 1. New-model car radios usually provide for insufficient space in the vehicle to place the connecting elements in-line with the car radio so that a single structure forming an adapter element is usually impossible to fit in the avialable space. Thus, the cable connection of FIG. 12 must be used. In combination with the conversion plug 10 of FIG. 1, the cable connector 12 provides an extension element to connect a new radio to a new-model antenna terminal, by plugging the element 10 into the receptacle 90. If the new radio is to be connected to an old antena, the conversion plug 10 is not then needed.

Various changes and modifications may be made within the scope of the inventive concept.

We claim:

1. Coaxial conversion receptacle and plug combination for connection of a new-model antenna terminal to an old-model antenna receptacle, in which the new-model antenna terminal has a cup-shaped connection element (51) adapted to make an electrical connection with its radially inner surface;

an insulating jacket (50) resiliently surrounding said cup-shaped connection element and insulating the outer surface thereof; and a projecting pin connection element (52) forming a center terminal, located essentially centrally within said cup-shaped connection element and being shielded thereby against high-frequency radio interference disturbances; and wherein the old-model antenna receptacle has a tubular sleeve (**40*b*) adapted to receive a pin element forming the center terminal for connection to a central conductor of the coaxial conversion plug and, axially offset with respect to said tubular sleeve (40*b*), an outer bushing terminal (40*a*) which forms at its inner surface, the outer terminal for an outer conductor of the coaxial conversion plug, said conversion plug including a pin-like tubular inner conductor (12, 18**);

an insulating sleeve (20) surrounding, at least in part, the pin-like tubular inner conductor; and an outer conductor (19) located at an outer surface of the insulating sleeve, wherein, in accordance with the invention, the inner conductor comprises a pin portion (18) and a bushing-like receptacle portion (15) electrically coupled to said pin portion;

the insulating sleeve (20) is formed with a central opening (21) receiving and retaining the inner conductor (12, 18); and the outer conductor (19) is tubular and secured over the insulating sleeve (20) and comprises a first connecting portion (13) dimensioned to fit into the outer bushing terminal (**40*a*) of the old-model receptacle, and a second connecting portion (16) having an outer diameter dimensioned to fit into the cup-shaped connecting element (51) of the new-model plug (50, 53**) and forming a unitary element with said first connecting portion.

2. The combination of claim 1, wherein said axial opening (21) of the insulating sleeve is formed with a radial enlargement (23) at the end thereof adapted for reception of the second connecting portion (16) of the outer conductor (19), and said inner conductor (18) is formed with a radially extendingn projection (22) fitting into the enlargement (23) of said opening.

3. The combination of claim 1, wherein the pin porton of the inner conductor is tubular.

4. The combination of claim 1, wherein the bushing-like receptacle portion (15) of the inner conductor comprises bent sheet-metal elements which, in cross section, are generally U-shaped or harp-shaped projecting pin connection elements (52) of the new-model antenna plug.

5. The combination of claim 1, further including an axially extending cut flap (35) formed in a medium region or zone of the outer conductor (19) which is part inwardly, part outwardly bent to form resilient contact spring elements.

6. The combination of claim 5, wherein the insulating sleeve (20) is formed with a depression (30) in the region of the free end of the cut flap for positioning of the cut flap, and defining an inner abutment or stop for the end portion of the cut flap.

7. The combination of claim 1, wherein the outer conductor (19) and the corresponding axial portion of the insulating sleeve (20) are formed with stepped regions (27, 28) for positive axial positioning of the outer conductor (19) on the insulating sleeve (20).

8. The combination of claim 1, further including a capacitor (63) located within the axial or cetral opening (21) of the insulating sleeve.

9. The combination of claim 8, wherein (FIGS. 7–11) the inner conductor (61) is a two-part element in which the pin portion (18) forms one prt (61) and the bushing-like receptacle portion (15) forms a second part;

and wherein the capacitor (63) electrically and mechanically connects said parts together.

10. The combination of claim 9, wherein (FIG. 9) the capacitor is a cylindrical capacitor (65), having axial connections, respectively connected to said parts (61, 62).

11. The combination of claim 10, wherein the capacitor (65) is located within the pin portion (61) and electrically connected with the free end of the pin portion (61) with one terminal, and having its second terminal (66) connected to said other part for mechanically and electrically connecting said parts together.

12. The combination of claim 8, wherein (FIG. 10) the capacitor is a tubular capacitor (80), a wire element (81) coupled to an inner layer (82) of said capacitor, and an outer layer (83) of the capacitor being coupled to the pin portion (61) and forming said pin part, the free end (85) of the wire element being galvanically connected to said other part and forming the bushing-like receptacle portion (62).

13. The combination of claim 8, wherein the pin portion (61) is formed wth a radially extending collar (69);

the bushing-like receptacle portion (62) is formed with at least one radially extending flap or collar portion;

and wherein the insulating sleeve (20) comprises two axially split insulating sleeve halves (74, 75), each formed with axially matching grooves (76, 78), and positioined and dimensioned to receive, respectively, the flange (69) and the flaps (70) of the inner conductor.

14. The combination of claim 1, in further combination with a cable connector (91) having an angle connector (92) having a new-model antenna plug angle connector at one end and an old-model antenna rceptacle (90) at the other end.

* * * * *